US005665014A

United States Patent [19]

Sanford et al.

[11] Patent Number: 5,665,014

[45] Date of Patent: Sep. 9, 1997

[54] METAL GOLF CLUB HEAD AND METHOD OF MANUFACTURE

[76] Inventors: Robert A. Sanford, 408 W. Camp McDonald Rd., Prospect Heights, Ill. 60070; Morris D. Logue, 612 Dunbar Cave Rd., Clarksville, Tenn. 37043

[21] Appl. No.: 241,231

[22] Filed: May 10, 1994

Related U.S. Application Data

[63] Continuation of Ser. No. 147,357, Nov. 2, 1993, abandoned.

[51] Int. Cl.[6] ..... A63B 53/04

[52] U.S. Cl. ..... 473/345; 473/349

[58] Field of Search ..... 273/167 R, 167 A, 273/167 H, 169, 171, 172, 173, 77 R; 473/324, 345, 349

[56] References Cited

U.S. PATENT DOCUMENTS

| | | | |
|---|---|---|---|
| 2,593,943 | 4/1952 | Wainer et al. . | |
| 2,709,651 | 5/1955 | Gurnick et al. . | |
| 2,902,363 | 9/1959 | Joyner . | |
| 2,939,199 | 6/1960 | Strivens . | |
| 3,847,399 | 11/1974 | Raymont . | |
| 4,076,254 | 2/1978 | Nygren . | |
| 4,113,480 | 9/1978 | Rivers . | |
| 4,158,688 | 6/1979 | Pett . | |
| 4,158,689 | 6/1979 | Pett . | |
| 4,225,345 | 9/1980 | Adee . | |
| 4,283,360 | 8/1981 | Henmi . | |
| 4,305,756 | 12/1981 | Wiech . | |
| 4,391,772 | 7/1983 | Bonner et al. . | |
| 4,404,166 | 9/1983 | Wiech . | |
| 4,429,879 | 2/1984 | Schmidt | 273/167 H |
| 4,430,061 | 2/1984 | Webb et al. . | |
| 4,432,549 | 2/1984 | Zebelean | 273/167 H |
| 4,438,931 | 3/1984 | Motomiya | 273/167 H |
| 4,465,221 | 8/1984 | Schmidt | 273/173 |
| 4,478,790 | 10/1984 | Huther et al. . | |
| 4,512,577 | 4/1985 | Solheim . | |
| 4,595,558 | 6/1986 | Baldwin et al. . | |
| 4,606,768 | 8/1986 | Svilar et al. . | |
| 4,614,627 | 9/1986 | Curtis et al. . | |
| 4,621,813 | 11/1986 | Solheim . | |
| 4,624,812 | 11/1986 | Farrow . | |
| 4,637,900 | 1/1987 | Frederickson . | |
| 4,708,741 | 11/1987 | Amaya . | |
| 4,721,599 | 1/1988 | Nakamura . | |
| 4,731,118 | 3/1988 | Svilar . | |
| 4,765,950 | 8/1988 | Johnson . | |
| 4,768,787 | 9/1988 | Shira . | |
| 4,782,205 | 11/1988 | Shira . | |
| 5,024,437 | 6/1991 | Anderson . | |
| 5,058,895 | 10/1991 | Igarashi . | |
| 5,060,951 | 10/1991 | Allen . | |
| 5,062,638 | 11/1991 | Shira . | |
| 5,094,383 | 3/1992 | Anderson et al. . | |
| 5,094,810 | 3/1992 | Shira . | |
| 5,122,324 | 6/1992 | Yong-Sup . | |
| 5,178,392 | 1/1993 | Santioni . | |
| 5,217,227 | 6/1993 | Shira . | |
| 5,261,664 | 11/1993 | Anderson . | |
| 5,294,037 | 3/1994 | Schmidt | 273/167 H |
| 5,362,055 | 11/1994 | Rennee . | |
| 5,378,295 | 1/1995 | Yamashita et al. . | |

*Primary Examiner*—Sebastiano Passaniti

[57] ABSTRACT

The present invention relates to an improved two-piece metal golf club head, formed by the powder metal injection molding process. A golf club head made according to the present invention is strong, durable, highly reproducible in terms of weight and dimensional accuracy, and efficient to manufacture.

7 Claims, 6 Drawing Sheets

METAL GOLF CLUB HEAD AND METHOD OF MANUFACTURE

This is a continuation-in-part of Ser. No. 08/147,357, filed on Nov. 2, 1993, now abandoned.

The present invention relates to an improved two-piece metal golf club head, formed by the powder metal injection molding process. A golf club head made according to the present invention is strong, durable, highly reproducible in terms of weight and dimensional accuracy, and efficient to manufacture.

BACKGROUND OF THE PRESENT INVENTION

A limited number of golf club heads known as "irons" are still produced by the traditional metal forging process, and some club heads known as "woods" are still produced by machining the heads from solid or laminated blocks of persimmon or other wood. However, the vast majority of golf club heads, both irons and woods, are now made of metal by the investment casting process. This process consists of casting molten metal into a mold around a foam or wax pattern. When the cast metal solidifies, the article is removed from the mold and the foam or wax core is then extracted to form a cavity within it.

In the case of so-called "metal woods," the result of the investment casting process is a hollow, partially complete club head that is completed by welding a bottom sole plate onto the head. It is also common in the art to add foam back into the hollowed portion of the head to provide additional weight, if desired, and to muffle the metallic sound of the metal club upon impact with a golf ball.

The development of metal club heads, particularly metal woods, formed by the investment casting process has greatly improved the overall performance of golf clubs by increasing the distance of drives in fairway shots. Metal woods are harder and stronger, thereby imparting greater power on the golf ball with an equivalent swing. Metal woods have also reduced the problem of distortion and warpage experienced by conventional wooden woods.

However, although the investment casting process has greatly improved the performance of golf clubs, there are inherent difficulties and limitations with golf club heads produced by the investment casting process. For example, pin holes sometimes form in the metal due to air or humidity entrapment in the investment foam. Another problem is that the investment casting process results in the occurrence of non-uniform wall thicknesses due to the uneven flow of the molten metal. Both of the above problems can affect the structural integrity of the golf club head, and frequently result in crinkles and damage when the golf club head is impacted repeatedly upon use.

Another problem inherent in the investment casting process relates to the reproducability or accuracy of products made by the process. As presently practiced, a separate foam or wax pattern for each club made by the investment casting process is made from a master die. This means that there will be slight dimensional variations from pattern to pattern. Such variations are further compounded by the effects of humidity, foam variables, melt chemistry, and pour conditions. These processing variations result in dimensional deviations in the final product which can impact negatively on important engineering characteristics of the club head.

In order to cope with the problems and limitations inherent to the investment casting process, foundries have been forced to resort to a 100% visual inspection of the golf club heads so produced. When defects are found, if fixable at all, secondary rework operations such as welding and grinding are required to correct the problems. This type of piece-by-piece inspection and repair is time consuming and adds to the overall cost of the final product.

The present invention substantially overcomes the problems associated with golf club heads produced by the investment casting process.

SUMMARY OF THE INVENTION

According to the present invention, powder metal injection molding is used to produce a metal golf club head which is stronger, has fewer structural deformities, is more consistent in terms of weight, wall thickness and dimensional characteristics, and is more efficient to manufacture than golf club heads typically manufactured by the investment casting process. The club head is formed of two component pieces, at least one of which is made by the powder metal injection molding process.

The powder metal injection molding process is generally described in, for example, U.S. Pat. No. 4,113,480 to Rivers, entitled "Method of Injection Molding Powder Metal Parts," and U.S. Pat. No. 4,721,599 to Nakamura, entitled "Method for Producing Metal or Alloy Articles" (both incorporated herein by reference).

As applied in the context of the present invention, powder metal injection molding entails injecting a mixture of fine metal powders (90–95% by weight) and thermoplastic or thermoset binder into a mold. The binder sets to form a solid "green" part (i.e., solid part held together by the plastic or binder) which is ejected from the injection mold. The green part is then further processed using heat and/or solvents to remove most of the plastic or binder. Finally, the part is sintered at a relatively high temperature, e.g., 2,300–2,400° F. This elevated temperature drives off any remaining plastic or binder and agglomerates the fine metal powder particles together into a final product without fully melting, so that the shaped part does not lose its shape.

The final product has a density of 90–98% of the density of a full wrought product. Although the part produced in the injection molding step shrinks considerably (approx. 20%) during sintering, the critical angles of the part are preserved. Thus, every component that is molded and later processed will have the same initial features, with very little distortion or variation. Moreover, since the powder metal injection molding process uses a master die for directly molding the parts, much greater accuracy and repeatability can be achieved for the critical shape and weight characteristics of the club head. This contrasts with the investment casting process, where inherent variability of the process from mold to mold results in variability of the resulting club heads.

For example, the loft angle of a club head, which determines the trajectory of a golf ball upon impact, preferably has a tolerance of no more than ±1°. However, the normal accuracy of the investment casting process is limited to a loft angle tolerance of ±2–3° due to the processing variations described above. Thus, the standard specification tolerances are limited by the inherent capability of the investment casting process.

Likewise, the lie angle of a golf club head, which defines how the club head addresses the ball, also has a tolerance of ±2–3° when produced by the investment casting process. When the two tolerance errors for the loft angle and lie angle of a club head combine at their extreme ranges the result could be an unplayable club. With the present invention, club heads can be produced with a lie angle tolerance of ±1.5° or less.

Another club head variable of importance relates to the face angle of the club. This refers to whether the club head face is angled into or away from the ball, which affects the lateral direction at which the golf ball will travel. For example, a "closed angle" or anti-slice club has been developed by moving the club face into the eleven o'clock position with reference to the club shaft. An "open angle" club counters a stronger player's tendency toward hooking by shifting the head angle to the one o'clock position with reference to the club shaft.

Golf club heads made according to the present invention, however, can be maintained to a tolerance of ±1° or better for all three of the above critical angles—loft, lie, and face angle. This constitutes an important improvement in reliability of the golf club.

It is also important for the head weight of each club to be accurate. For example, each iron club head is designed to become progressively heavier by approximately 5–7 grams as one progresses from the longer irons, such as a #2 iron, through to the shorter irons, such as a pitching wedge or sand wedge. Likewise, metal woods become progressively heavier by approximately 5 grams each as one progresses from the longer woods, such as a #1 wood, through to the higher number woods, such as a #5 wood. Heavier head weights are required as clubs get progressively shorter so that the club, regardless of length, will maintain the same swing weight and balance.

The currently used investment casting process has a weight tolerance of ±2–5 grams. Such tolerances are very difficult to maintain on a constant basis due to the nature of the investment casting process and the required secondary operations of hand grinding and polishing. The large gate and runner vestiges common to investment casting require a large number of secondary operations just to achieve weight specifications of ±3 grams. Golf club heads formed according to the present invention, on the other hand, achieve weight tolerances of ±2 grams or better without requiring the extensive secondary operations.

Another important advantage of the present invention is that the powder metal injection molding process substantially eliminates the presence of pin holes and other defects affecting the structural integrity of the golf club head, as are common to the investment casting technique. This reduces the number of unusable club heads produced, and diminishes the need for rigorous inspection.

Also, because the powder metal injection molded material has a slightly lower density than the wrought material, it is possible to make the striking area of the club head thicker and thus reinforcing the hitting surface, while still maintaining proper weight specifications. Such reinforcement gives a more solid impact and feel to the club, thereby providing better control.

The club head of the present invention is formed of two component pieces or portions: a front portion which includes the hitting surface and shaft junction being one component, and a back portion constituting the other component. By molding the hitting surface and shaft junction in one single piece, the critical angular relationships of the club head—i.e., loft angle, lie angle, and face angle—are incorporated in a single piece. This allows for great accuracy and repeatability of these critical dimensions from club head to club head, as noted above.

The back portion of the club head, opposite the hitting surface, is preferably also be made by powder metal injection molding, or, alternatively it can be made of plastic, fiberglass, or any other suitable material, depending on the desired characteristics. The two portions are joined by interlocking the two portions together, or by welding, braising or gluing with epoxies, or any combination of these methods. Secondary features can also be included to facilitate alignment and joining of the two club head portion. For example, the mating edges of each portion can be formed with a lip, ridge, groove, or the like, which interlocks with a corresponding feature on the other portion. This provides for both easier alignment and greater strength between the two portions when joined.

DESCRIPTION OF THE DRAWINGS

In order that the invention may be more easily understood, reference is made to the accompanying drawings in which.

DETAILED DESCRIPTION OF THE PRESENT INVENTION

Figure 1:
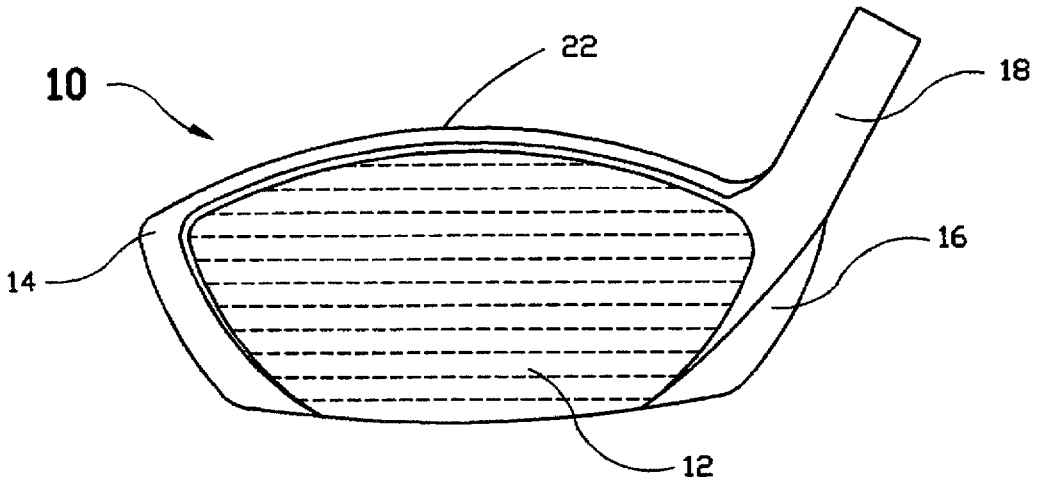
FIG. 1 is a frontal view of a golf club head according to the present invention.

A metal golf club head according to a preferred embodiment of the present invention is shown in FIGS. 1–6, generally indicated by reference numeral 10.

Figure 2:
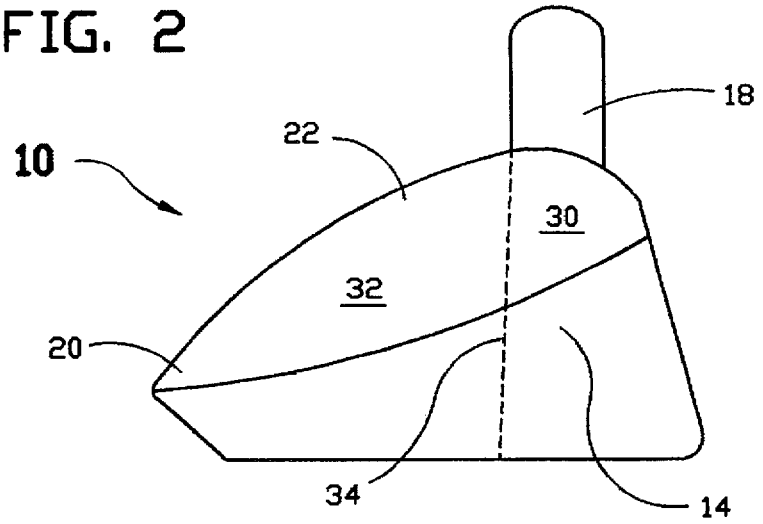
FIG. 2 is an end view toward the toe of a golf club head according to the present invention.
Figure 3:
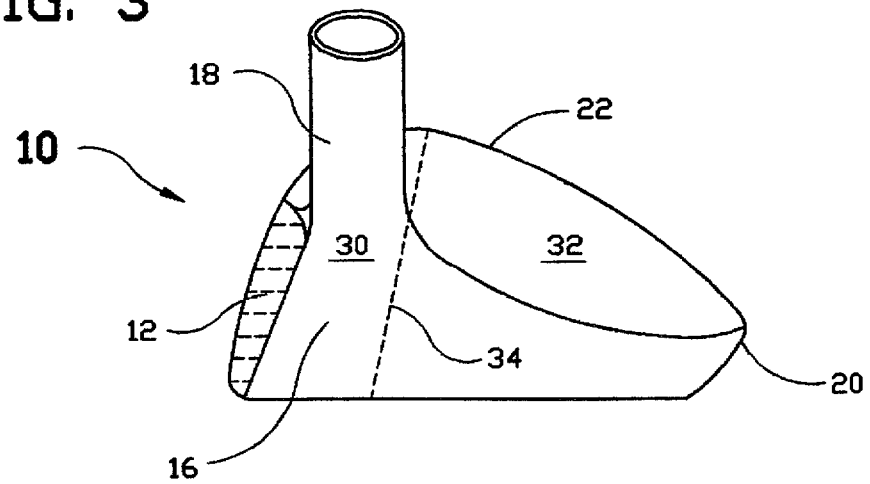
FIG. 3 is an end view toward the heel of a golf club head according to the present invention.
Figure 4:
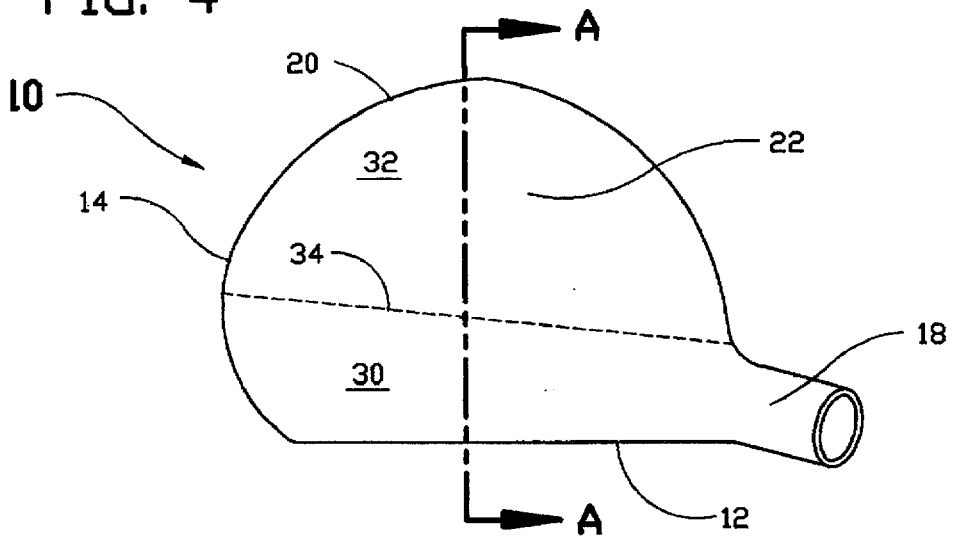
FIG. 4 is a top view of a golf club head according to the present invention.
Figure 5:
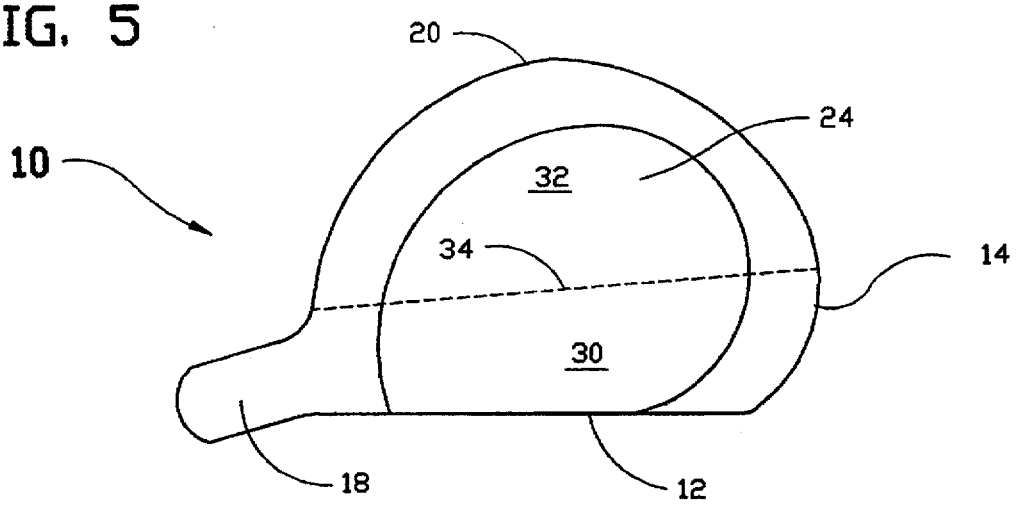
FIG. 5 is a bottom view of a golf club head according to the present invention.

Golf club head 10 is of the type commonly known as a "wood," and includes a face 12, toe 14, heel 16, and shaft junction 18, as best seen in FIGS. 1–3. It also includes, as best seen in FIGS. 2–4, a back portion 20 and a top surface 22, as well as a sole 24, as best seen in FIG. 5.

According to the present invention, golf club head 10 is made of two or more component pieces, at least one of which is formed by the powder metal injection molding process. In the preferred embodiment of the invention, the club head 10 is comprised of two portions, a front portion 30 and a back portion 32, as divided by dashed line 34 in FIGS. 2–5. In this configuration, the front portion 30 contains the club face 12 and shaft junction 18 together in a single piece, which is important in order to better maintain the critical angular relationships of the club head 10, i.e., the loft, lie, and face angles. Both portions 30 and 32 are preferably produced by the powder metal injection molding process.

This produces highly accurate pieces which can then be joined together by welding, brazing, or gluing.

FIGS. 7–11 have dashed lines representing possible alternative divisions of golf club head 10 into two portions according to the invention. As these figures illustrate, virtually any division of the club head into two component pieces is possible.

For example, golf club head 10 could be composed of two portions as indicated by dashed line 36 in FIGS. 7–9 and 11, with one portion including the toe 14 of the club and the other portion including the heel 16 and shaft junction 18. Another alternative would be to divide the club head into two portions as variously indicated by dashed lines 38, 40, and 42 in FIG. 7, with one portion including the hitting face and shaft junction, and the other portion including the back of the club head. The club head may also be divided diagonally along dashed line 39, as shown in FIG. 10.

Figure 8:
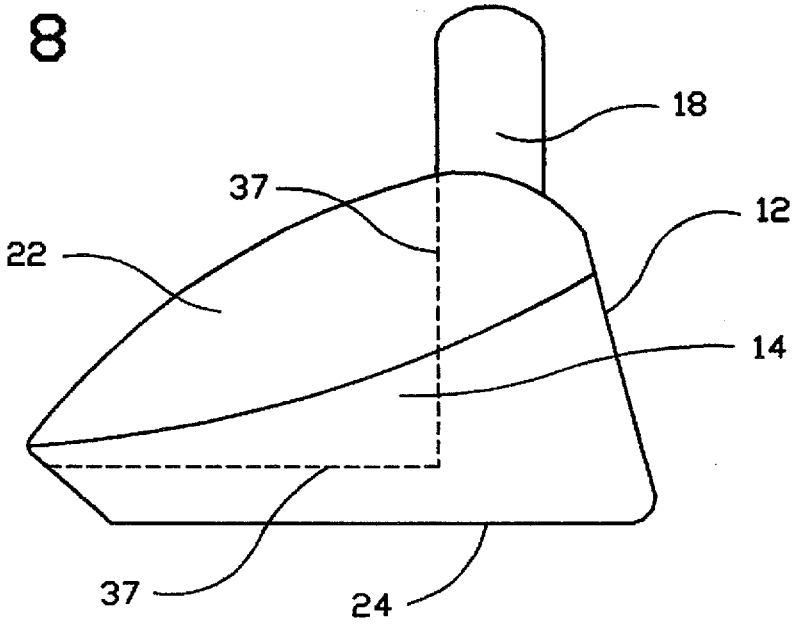
Figure 9:
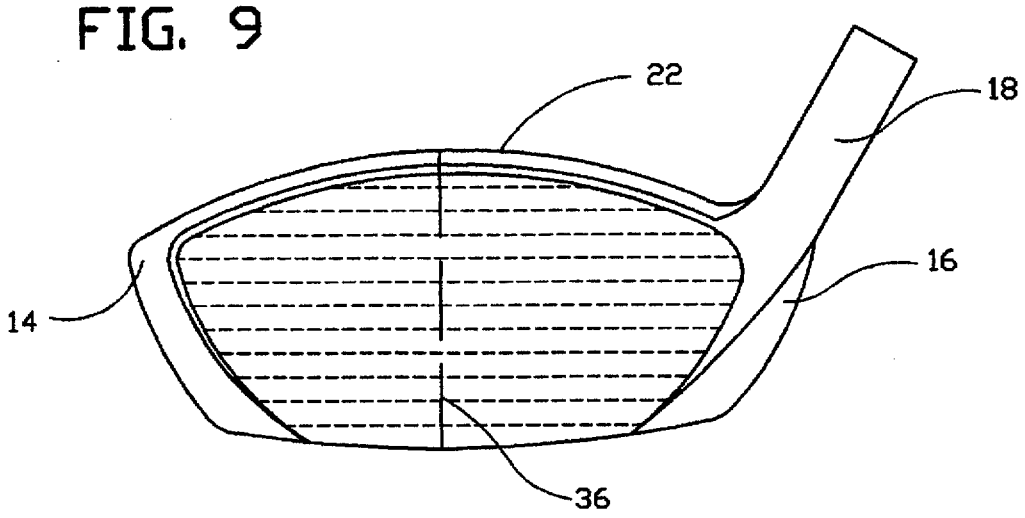
Figure 10:
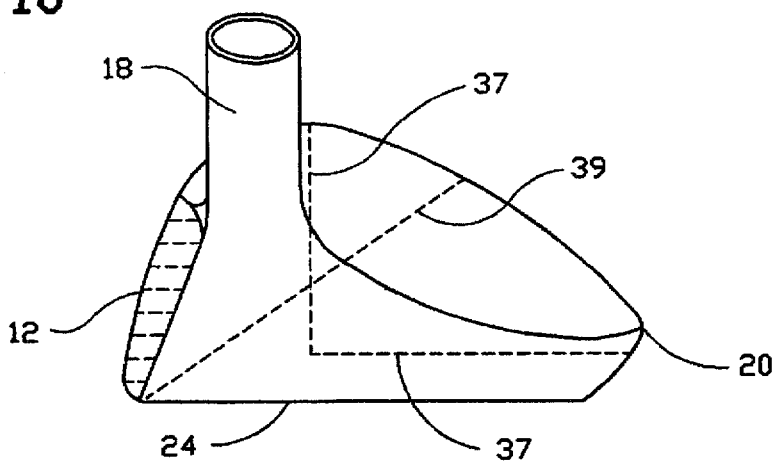
Figure 11:
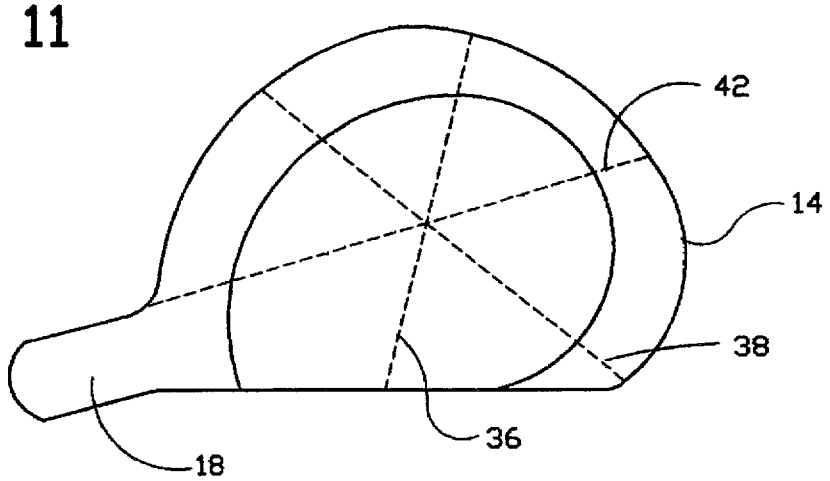

FIGS. 8 and 10 show another variation indicated by dashed line 37 where one club head portion includes the hitting face 12, shaft junction 18, and sole 24, and the other portion is essentially a quarter wedge piece which includes part of the top surface 22, toe 14, and back 20 of the club head. It should be noted, however that any pieces to be injection molded may not have reentrant angles, so that they can be ejected from their molds without breaking.

In the powder metal injection molding process, each club head portion is made separately by injecting a mixture of powder metal and plastic or binder under pressure into a mold at approximately 400 F. Once the mixture sets, the piece is ejected from its mold and processed by heating to approximately 1000 F. to remove most of the plastic or binder. The club head portions 38 and 40 are designed so that they do not have reentrant angles, so that they can be ejected from their molds without breaking.

Finally, each piece is heated to a temperature adequate to sinter the metal powder, e.g., 2300–2400 F., which also removes any remaining plastic or binder and consolidates the metal powder into a solid piece. The sintering process results in approximately 20% shrinkage of the part. However, since the shrinkage is uniform, the resulting product will maintain the desired angular relationship.

All of the standard alloys common to the art can be used for making golf club heads with the powder metal injection molding process, such as the 300 series stainless and precipitation hardenable alloys. The temperature of the heating process must be adjusted to cause the particular metal powder to sinter properly.

Alternatively, the back portion 32 can be formed of plastic, fiberglass, or other material, and may or may not be formed by an injection molding process. Since the back portion of the club does not undergo the same stress as the front, it can be made of other materials, such as plastic. This may be desirable in order to reduce cost or to achieve certain weight characteristics.

Figure 6:
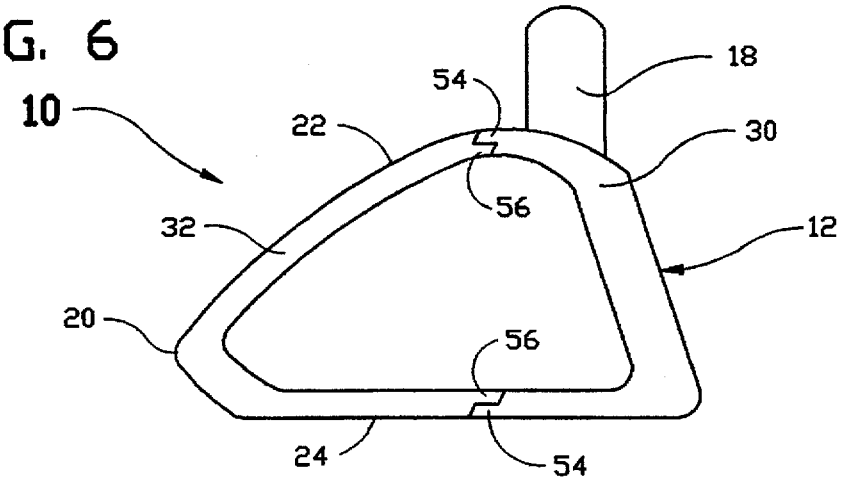
FIG. 6 is a cross sectional view of a golf club head along line A—A in FIG. 4.
Figure 7:
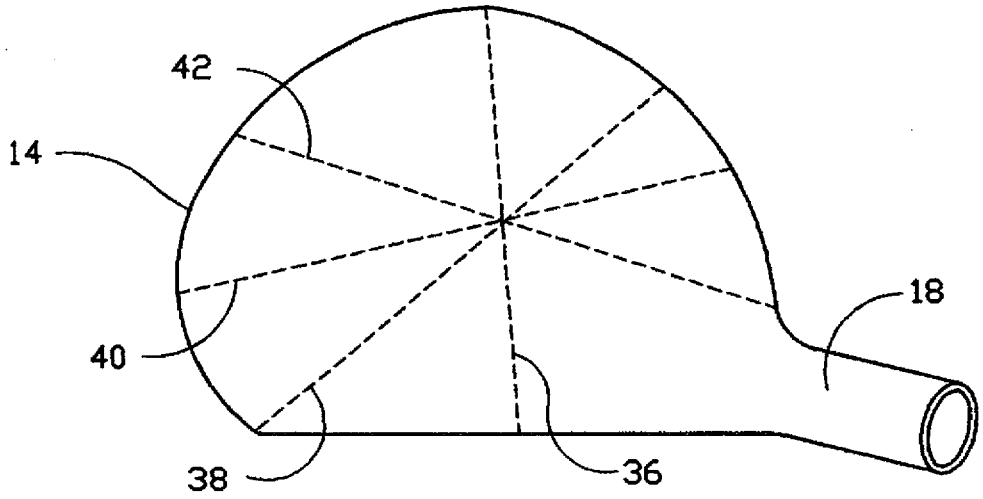
FIGS. 7–11 are top, toe end, front, heel end, and bottom views, respectively, of a golf club head according to the present invention with dashed lines illustrating alternative locations where the club head may be divided into portions.
Figure 12:
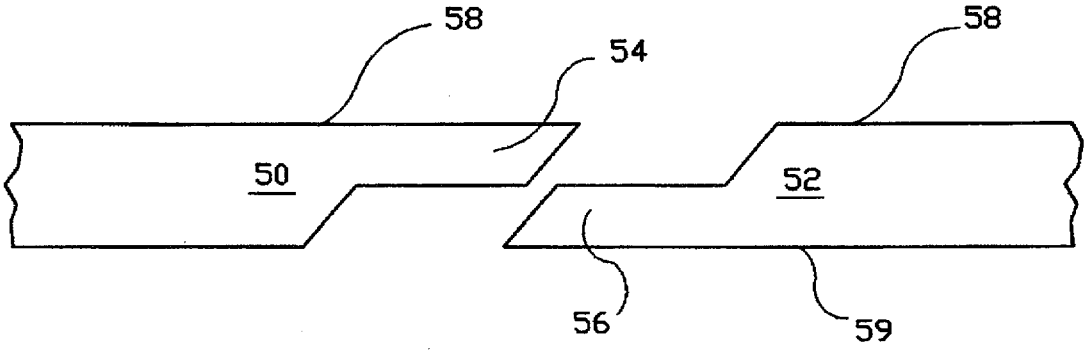
FIGS. 12–14 are cross sectional diagrams showing three alternative mating wall edge configurations for joining together the portions of a golf club head according to the present invention.
Figure 13:
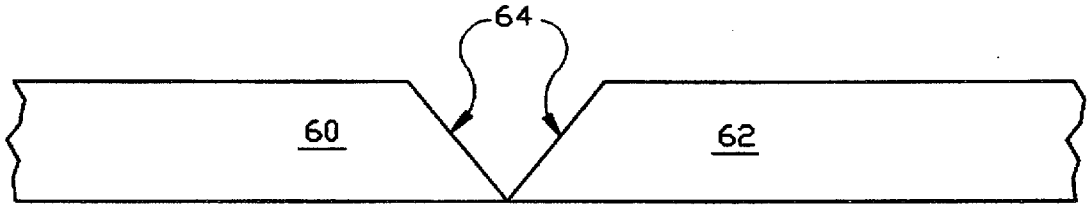
Figure 14:
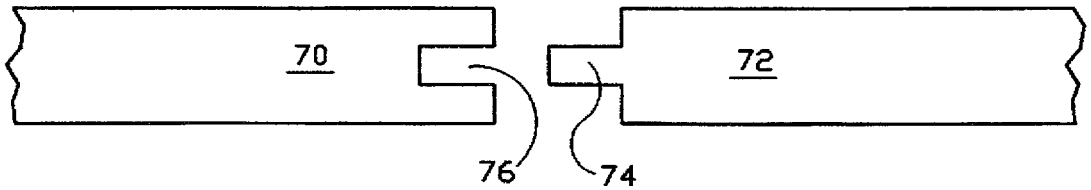
Figure 15:
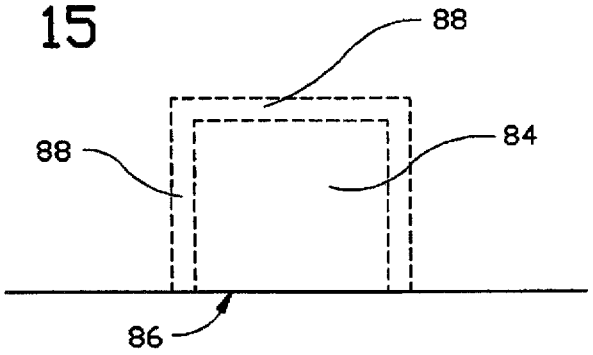
FIG. 15 is a top view of a wall of one portion of a golf club head showing an alternative mating wall edge configuration.
Figure 16:
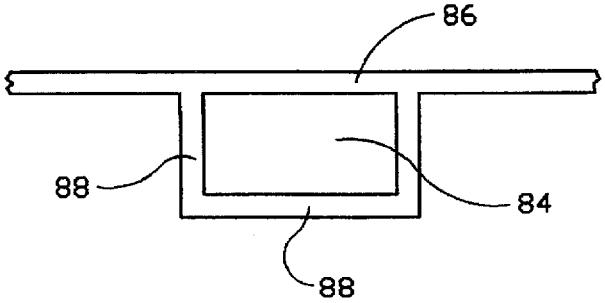
FIG. 16 is a front view of the mating wall edge of FIG. 15.

Once the two or more club head portions are formed, they are bonded together by welding, brazing, or gluing to form a completed golf club head 10. In order to facilitate joining of the club head portions, it is preferred to form the mating wall edges of each portion with an interlocking or mating configuration, such as is shown in FIGS. 12–18. FIG. 12 shows a cross sectional diagram of the club head wall at the mating edge of two wall portions 50 and 52. One wall portion 50 has an outer lip 54 extending from its edge at the exterior surface 58 of the wall, and the opposite portion 52 has an inner lip 56 extending out from the wall edge at the interior surface 59 of the wall. FIG. 6 shows a cross sectional view of club head 10 utilizing a matting edge configuration like that of FIG. 12, with outer lip 54 interlocking with inner lip 56. This allows the two club head portions to be snapped together and thereby facilitates aligning and joining of the portions with one another.

Figure 17:
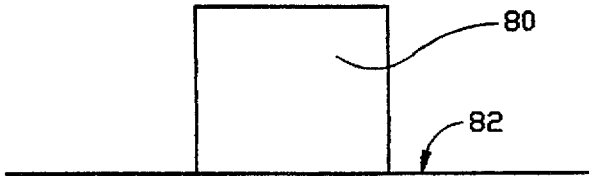
FIG. 17 is a top view of the mating wall edge of the portion opposite the wall edge shown in FIG. 15.

FIG. 17 shows a "V"-shaped mating edge between two club head wall portions 60 and 62, with the top of the "V" opening toward the exterior surface of the club head. This configuration is desirable when the club head portions are to be joined by welding, since the welding material will fuse with the exposed slanting surfaces 64 of the "V" while simultaneously filling it in, thus providing a strong weld.

Figure 18:
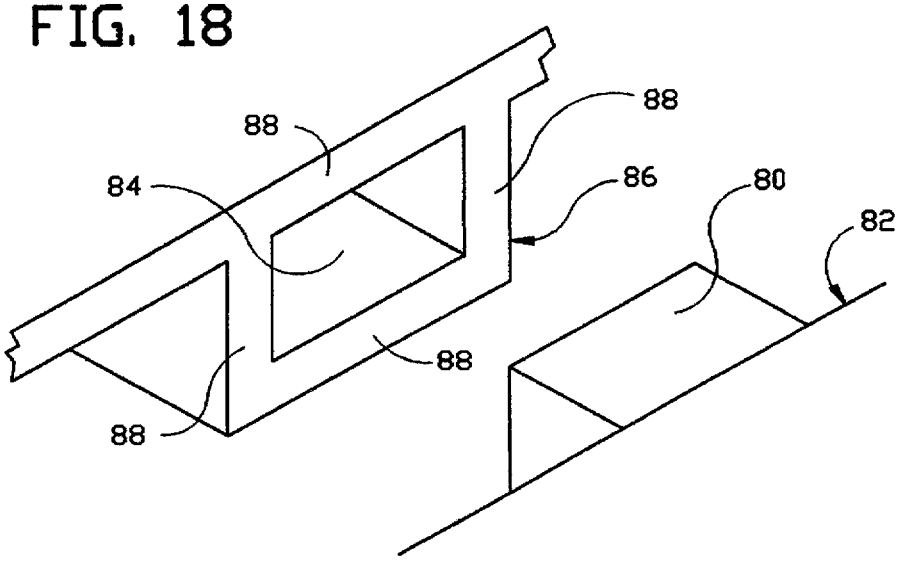
FIG. 18 is a perspective view of the two opposite mating wall edges of the portions shown in FIGS. 15–17.

Another configuration is shown in FIG. 18, in which a median lip 74 extends from the middle of the mating edge of one club head wall portion 72 and fits into a channel 76 formed in the mating edge of the other club head wall portion 70. Again, this allows the two club head portions to be fit accurately and tightly together for improved alignment and bonding.

FIGS. 15–18 show another mating configuration where there are rectangular pegs 80 extending out from the mating edge of one club head wall portion 82, as shown from above in FIG. 17 and in perspective in FIG. 18. The rectangular pegs 80 fit into rectangular cavities 84 formed by walls 88 on the underside of the mating edge of the opposite club head wall portion 86. This provides a strong, accurate interlocking mechanism for joining the two club head portions together and can be used in combination with the other mating edge configurations described above.

After bonding of the two (or more) club head portions together to form a completed golf club head, minor finishing operations may be performed to finish the seam between the portions. However, unlike club heads made by the investment casting process, extensive secondary operations are not needed.

From the foregoing, it can be seen that a metal golf club head has been provided which fully meets the objects of the instant invention. While the device has been described in the terms of a preferred embodiment, there is no intent to limit the invention to the same. On the contrary, it is intended to cover all modifications and equivalents within the scope of the appended claims.

What is claimed is:

1. A two-piece golf club head comprising:

(a) a first metal portion which includes a hitting face that has a thickness which is greater than that of the remainder of the first metal portion, said first metal portion having a shape with no reentrant angles and having been formed by powder metal injection molding; said first metal portion including a peripheral edge which defines a cavity;

(b) a second portion having an edge having a shape which complements the shape of and is adapted to mate with said first metal portion edge;

(c) said first metal portion and said second portion being permanently joined together at said edges to form a golf club head having an internal cavity.

2. The golf club head of claim 1, wherein said first metal portion comprises the hitting face and the shaft junction.

3. The golf club head of claim 1, wherein said second portion is a metal portion having a shape with no reentrant angles that has been formed by a powder metal injection molding process.

4. The golf club head of claim 1, wherein said first metal portion includes a mechanical first interlock element and said second portion includes a second mechanical interlock element, whereby said elements cooperate to lock said first metal portion to said second portion when said portions are joined.

5. The golf club head of claim 1, wherein said first metal portion and said second portion are joined by welding, brazing, or gluing.

6. The golf club head of claim 1, wherein said first metal portion includes a guide which aligns the edge of said first metal portion with said second portion when said first metal portion and said second portion are joined together.

7. The golf club head of claim 6, wherein said second portion includes a guide, wherein said second portion guide cooperates with said first metal portion guide to align the respective edges when said first metal portion and said second portion are joined together.

* * * * *